US009828161B2

(12) United States Patent
Erle

(10) Patent No.: US 9,828,161 B2
(45) Date of Patent: Nov. 28, 2017

(54) MICROWAVEABLE PACKAGES HAVING A COMPOSITE SUSCEPTOR

(75) Inventor: Ulrich Johannes Erle, Cleveland, OH (US)

(73) Assignee: Nestec S.A., Vevey (CH)

( * ) Notice: Subject to any disclaimer, the term of this patent is extended or adjusted under 35 U.S.C. 154(b) by 0 days.

(21) Appl. No.: 14/122,914

(22) PCT Filed: May 23, 2012

(86) PCT No.: PCT/EP2012/059586

§ 371 (c)(1),
(2), (4) Date: Nov. 27, 2013

(87) PCT Pub. No.: WO2012/163755

PCT Pub. Date: Dec. 6, 2012

(65) Prior Publication Data

US 2014/0113036 A1 Apr. 24, 2014

(30) Foreign Application Priority Data

May 31, 2011 (WO) ..... PCT/US2011/038583

(51) Int. Cl.
*B65D 81/34* (2006.01)

(52) U.S. Cl.
CPC .. *B65D 81/3461* (2013.01); *B65D 2581/3472* (2013.01); *B65D 2581/3489* (2013.01); *B65D 2581/3494* (2013.01)

(58) Field of Classification Search
CPC ..... B65D 81/34
See application file for complete search history.

(56) References Cited

U.S. PATENT DOCUMENTS

| | | | | |
|---|---|---|---|---|
| 4,190,757 | A | 2/1980 | Turpin et al. | |
| 4,283,427 | A | 8/1981 | Winters et al. | |
| 4,825,024 | A | 4/1989 | Seaborne | |
| 5,362,504 | A * | 11/1994 | Kamper | A23P 20/11 426/601 |
| 6,348,679 | B1 * | 2/2002 | Ryan et al. | 219/634 |
| 2005/0230384 | A1 * | 10/2005 | Robison | A47J 36/022 219/730 |

(Continued)

OTHER PUBLICATIONS

Russian Office Action for Application No. 2013157170/12(089112), dated May 20, 2016, 6 pages.

*Primary Examiner* — Michele L Jacobson
*Assistant Examiner* — Preston Smith
(74) *Attorney, Agent, or Firm* — K&L Gates LLP

(57) ABSTRACT

Microwaveable packages having composite susceptors and methods for using same are provided. In a general embodiment, composite susceptors for cooking microwaveable foods (12, 14) in a microwave oven are provided. The composite susceptors may include, for example, a first layer that is a standard microwave susceptor (30) and a second layer (32) comprising mobile charges, wherein the second layer is at least substantially metal free. The second layer comprising mobile charges can both shield the standard susceptor from microwaves, and act as a conductor to increase the conductivity of the standard susceptor. The composite susceptors of the present disclosure provide improved surface heating patterns that are similar to surface heating patterns of conventional ovens, while also providing the benefits of microwave cooking.

15 Claims, 7 Drawing Sheets

(56) References Cited

U.S. PATENT DOCUMENTS

| | | | | |
|---|---|---|---|---|
| 2006/0000828 | A1* | 1/2006 | Watkins | B65D 81/3446 219/730 |
| 2007/0029314 | A1* | 2/2007 | Rodgers et al. | 219/730 |
| 2009/0032529 | A1* | 2/2009 | Lafferty | B65D 81/3446 219/730 |

* cited by examiner

MICROWAVEABLE PACKAGES HAVING A COMPOSITE SUSCEPTOR

CROSS REFERENCE TO RELATED APPLICATIONS

The present application is a National Stage of International Application No. PCT/EP2012/059586, filed on May 23, 2012, which claims priority to International Application No. PCT/US2011/038583, filed May 31, 2011, the entire contents of which are being incorporated herein by reference.

BACKGROUND

The present disclosure relates generally to food technologies. More specifically, the present disclosure relates to microwaveable packages including a composite susceptor having a standard susceptor layer and a microwave shielding layer that is at least substantially metal free.

The microwave oven has become an increasing popular means for cooking food due to consumer convenience, energy efficiency and reduction of power consumption during food preparation. While microwave cooking provides volumetric heating of a food product that is typically slightly hotter on an outside of the food product, microwave cooking typically does not provide desired surface heating to achieve a browned, crisp surface of the food product. Indeed, microwave cooking is unable to provide a food product having a browned, crisp surface because the surface of the food product generally does not get significantly hotter than the center of the food product. In contrast, conventional ovens often provide such foods with a surface that is browned, crisp and desirable to consumers. Nevertheless, conventional ovens also require a significantly increased amount of preparation time since food products heated by conventional ovens are heated relatively slowly from the outside inward.

Microwave susceptor materials are known in the food industry and have been used as active packaging systems with microwaveable foods since the late 1970's. Susceptors are used to provide additional thermal heating on the surface of food products that are heated in a microwave oven, which helps to achieve a browned, crisp surface that is desirable to consumers. While the use of microwave susceptors can provide improved characteristics for microwave cooked foods, susceptors are not necessarily capable of imparting desired temperature profiles to all microwaveable foods.

For example, U.S. application Ser. No. 12/465,700 to Michael ("Michael") discloses the challenges faced when preparing a frozen consumer-heatable pastry product with an ice cream filling. As discussed in Michael, the ice cream portion of the frozen consumer-heatable pastry products are typically exposed to temperatures during the manufacturing process and the consumer heating process that cause the ice cream to melt or otherwise degrade. To prevent such issues, the frozen products of Michael are formulated with a "cook-stable" ice cream that is more tolerant of heat exposure conditions than are typical such that the cook-stable ice cream does not melt-out or otherwise degrade during at least the pre-cooking operation. However, the cook-stable ice cream solution of Michael requires reformulation of the ice cream filling and limits the types of frozen compositions that may be included in frozen consumer-heatable pastry products without experiencing melting or other degradation.

As such, there exists no suitable manner in which to prepare a hot-and-cold food product in the microwave oven that includes any edible, frozen component and that also provides a temperature profile that is close to that from conventional oven preparation, while also providing a browned, crisp surface.

SUMMARY

The present disclosure is related to microwave technology. Specifically, the present disclosure is related to microwaveable packages that provide improved heating patterns. In a general embodiment, a microwaveable package is provided and includes a composite susceptor having a standard microwave susceptor layer adjacent to a microwave shielding layer. The microwave shielding layer includes a source of mobile charges that is at least substantially metal free.

In an embodiment, the microwave shielding layer includes a substrate including the source of mobile charges. The substrate may have a thickness from about 0.05 mm to about 3.0 mm, or about 0.25 mm. In an embodiment, the substrate is paper, paperboard, cardboard, cardstock, tissue paper, crepe paper, or combinations thereof. In an embodiment, the substrate is a paper-based substrate such as a tissue paper.

In an embodiment, the source of mobile charges is selected from the group consisting of melted ionic compounds, dissolved ionic compounds, semiconductors, or combinations thereof. The source of mobile charges may be selected from the group consisting of melted salt, salt water solution, or combinations thereof. In an embodiment, the source of mobile charges is a salt water solution having a concentration from about 10% to about 30% by weight. The salt water solution may have a concentration of about 25% by weight. In an embodiment, the microwave shielding layer is a paper-based substrate immersed in a salt water solution.

In an embodiment, the microwaveable package is selected from the group consisting of a pouch, a sleeve, a box, or combinations thereof.

In an embodiment, the microwaveable package further includes a second standard microwave susceptor layer located between the first standard microwave susceptor layer and the microwave shielding layer.

In an embodiment, the microwaveable package is so constructed and arranged to be a closed package such that an interior of the microwaveable package is closed from an environment on an inside of the microwaveable package. For example, all surfaces of the microwaveable package may include the composite susceptor.

In an embodiment, the microwaveable package includes a pure microwave shield layer that is separate from the standard microwave susceptor layer and the microwave shielding layer. The pure shield layer may be a metal layer such as, for example, aluminum foil.

In an embodiment, the microwave shielding layer covers substantially all of an outside surface of the standard susceptor layer.

In another embodiment, a microwaveable package is provided and includes a standard microwave susceptor layer, and a shielding layer having a source of mobile charges that is at least substantially metal free. The shielding layer may be so constructed and arranged to (i) shield the standard microwave susceptor layer from microwaves in a first portion of microwave heating and (ii) to allow the temperature of the standard microwave susceptor layer to rapidly increase during a second portion of microwave heating.

In an embodiment, the first portion of microwave heating comprises an amount of time that is up to about 40 seconds. The second portion of microwave heating is after the first portion of microwave heating and may include an amount of time that is up to about 40 seconds.

In an embodiment, the microwave shielding layer includes a substrate including the source of mobile charges. The substrate may have a thickness from about 0.05 mm to about 3.0 mm, or about 0.25 mm. In an embodiment, the substrate is a paper-based substrate such as paperboard, cardboard, cardstock, tissue paper, crepe paper, or combinations thereof. In an embodiment, the substrate is tissue paper.

In an embodiment, the source of mobile charges is selected from the group consisting of melted ionic compounds, dissolved ionic compounds, semiconductors, or combinations thereof. The source of mobile charges may be selected from the group consisting of melted salt, salt water solution, or combinations thereof. In an embodiment, the source of mobile charges is a salt water solution having a concentration from about 10% to about 30% by weight. The salt water solution may have a concentration of about 25% by weight. In an embodiment, the microwave shielding layer is a paper-based substrate immersed in a salt water solution.

In an embodiment, the microwaveable package is selected from the group consisting of a pouch, a sleeve, a box, or combinations thereof. In another embodiment, the microwaveable package is a flexible package material.

In an embodiment, the microwaveable package further includes a second standard microwave susceptor layer located between the first standard microwave susceptor layer and the microwave shielding layer.

In an embodiment, the microwaveable package includes a pure microwave shield layer that is separate from the standard microwave susceptor layer and the microwave shielding layer. The pure microwave shield layer may include a metal layer such as, for example, aluminum foil.

In yet another embodiment, a method for making a composite microwave susceptor is provided. The method includes providing a standard microwave susceptor layer, providing a microwave shielding layer comprising a source of mobile charges, wherein the microwave shielding layer is at least substantially metal free, and attaching the microwave shielding layer to an outer surface of the standard microwave susceptor layer.

In an embodiment, the microwave shielding layer is attached to the standard microwave susceptor layer using a component selected from the group consisting of glue, tape, or combinations thereof.

In an embodiment, the microwave shielding layer includes a substrate including the source of mobile charges, wherein the source of mobile charges is selected from the group consisting of melted ionic compounds, dissolved ionic compounds, semiconductors, or combinations thereof.

In an embodiment, the substrate is a paper-based substrate that has a thickness from about 0.05 mm to about 3.0 mm.

In an embodiment, the source of mobile charges is a salt water solution having a concentration from about 10% to about 30% by weight.

An advantage of the present disclosure is to provide an improved microwave susceptor.

Another advantage of the present disclosure is to provide an improved microwave susceptor that creates a temperature profile in a food product that is similar to that achieved by conventional oven preparation.

Yet another advantage of the present disclosure is to provide a microwave susceptor that provides improved browning and crispness of a food product.

Still yet another advantage of the present disclosure is to provide a microwave susceptor that imparts a stronger surface heating to a food product.

Yet another advantage of the present disclosure is to provide a microwave susceptor that is capable of (i) heating a food product using microwaves, and (ii) shielding a standard susceptor from microwaves.

Another advantage of the present disclosure is to provide an improved method for microwave cooking a food product.

Additional features and advantages are described herein, and will be apparent from, the following Detailed Description and the figures.

DETAILED DESCRIPTION

Figure 1:
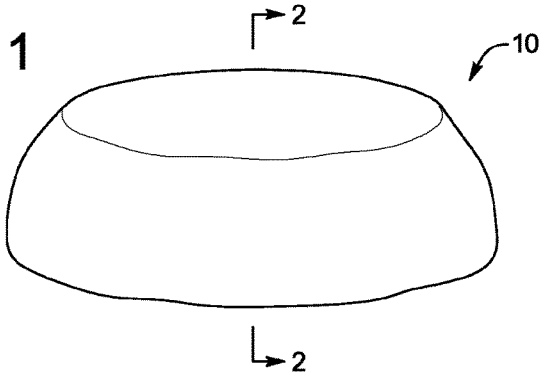
FIG. 1 is a perspective view of a microwaveable food product that may be heated in a microwaveable package in accordance with an embodiment of the present disclosure.

The present disclosure is generally directed to food technology. More specifically, the present disclosure is directed to composite food products packaged in microwaveable packages having a composite susceptor. Microwave susceptors have been used with microwaveable foods since the late 1970's. Susceptors are used to provide additional thermal heating on the outside of food products that are heated in a microwave oven. The added thermal heating imparts a browned, crisp surface to the food product that is generally desired by consumers and typically only achieved when a food product is heated by a conventional oven.

Although there are several different types of susceptors in use, most susceptors are aluminum metallized polyethylene terephthalate ("PET") sheets. The PET sheets may be lightly metallized with elemental aluminum laminated onto a dimensional stable substrate such as, for example, paper or paperboard. Indeed, standard susceptor materials have a very thin layer of metal atoms (e.g., aluminum atoms). This thin layer is typically about 20 atoms and is just thick enough to conduct electricity. Since the thickness of the layer is so small, however, and the resulting resistance is high, the currents are limited and do not cause any arcing in the microwave, as is seen with other metallic articles in the microwave. The current is sufficiently high, however, to heat the susceptor to a temperature that is high enough to provide brownness and crispness to the outside surface of a food product. As used herein, "standard microwave susceptor" or "standard susceptor" means a susceptor know to the skilled artisan prior to the present disclosure, which may include, for example, the lightly metallized susceptors described above having a substrate, a thin layer of metal atoms and a polymer layer.

The development of heat energy in a susceptor placed in a microwave field is caused by the conductivity of the susceptor material. For example, a thin aluminum film with a relatively high resistance acts as the main source of heat energy. The ohmic resistance in the thin aluminum layer then leads to absorption and dissipation of microwave energy. The portion of an incident wave that is not absorbed, is partially transmitted by the susceptor material, making it available for direct volumetric heating of the food. The remaining portion of the microwave energy is reflected by the susceptor material.

This concept of standard susceptor heating works well for frozen food, which is essentially transparent to microwaves and does not absorb much microwave energy itself. As a result, a relatively high electric field strength is left for the susceptor to heat up and form a crust on the surface of the food. Non-frozen foods, however, absorb microwaves much better than frozen foods. The field strength, therefore, is much lower, which leads to less heating effect in the susceptor material. Consequently, standard susceptor materials often show insufficient performance in combination with non-frozen foods. The present disclosure provides microwave susceptor materials that may be used with frozen or non-frozen foods, or a combination of frozen and non-frozen foods.

The microwaveable packages of the food products of the present disclosure include composite susceptors that are able to create a temperature profile in a food product heated in a microwave that is close to that of a food product heated by a conventional oven. In this manner, the susceptors provide sufficient shielding from the microwaves while, at the same time, heating up enough to provide increased surface heating to the food product. One significant advantage of the present susceptors is the ability to provide a hot-and-cold dessert product that is able to be cooked in a microwave oven. This is advantageous because known susceptors are unable to impart the required temperature profile to such a product during cooking. In other words, known susceptors do not include shielding layers that prevent standard susceptors layers from becoming too hot and cracking, or melting the frozen component, while also allowing standard susceptors to increase substantially in temperature during the last portion of microwave cooking to provide a browned, crisp surface to the food product. Instead, standard susceptors are either too transmittive so as to melt the inner frozen component, or the susceptor fails (e.g., cracks) due to increased heat and is unable to properly heat the food product. While the present disclosure will discuss an embodiment wherein the microwaveable food product is a hot-and-cold dessert product, the skilled artisan will appreciate that the present susceptors may also be used with any type of microwaveable food product.

Figure 2:
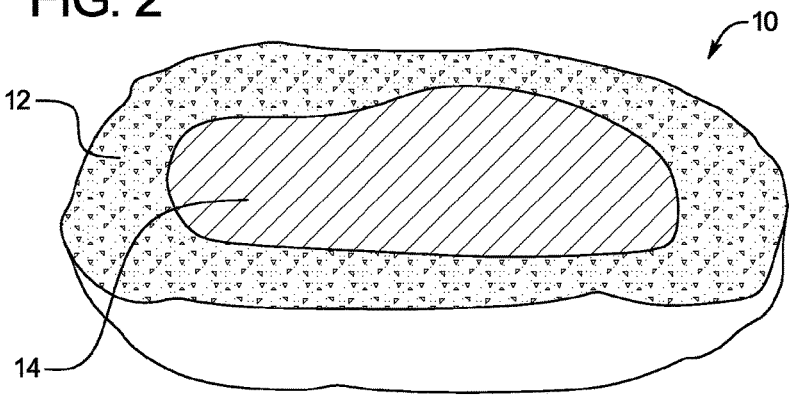
FIG. 2 is a cross-sectional view of the microwaveable food product of FIG. 1 taken along line 2-2 in accordance with an embodiment of the present disclosure.

As shown in FIG. 1, a microwaveable food 10 is provided. In an embodiment, microwaveable food 10 includes an outer portion 12 and an inner filling portion 14, as is shown by FIG. 2. As is also shown in FIGS. 1 and 2, microwaveable food 10 assumes a substantially oblong configuration. In other words, microwaveable food 10 has an elongated shape and substantially curved sides. However, while microwaveable food 10 is shown in a substantially oblong configuration, other geometric shapes are possible. For example, microwaveable food 10 may be shaped substantially cylindrical, circular, square, triangular or may have other various geometric shapes.

Outer portion 12 of microwaveable food 10 may be a dough product, a pastry product, or another type of solid or semi-solid microwaveable food. Outer portion 12 may be fully cooked, partly cooked or raw at the time of manufacture, packaging and/or storage of same. Outer portion 12 should be a composition, however, that is intended to be cooked (or baked) in a microwave oven. In an embodiment wherein microwaveable food 10 is a hot-and-cold product, outer portion 12 provides the hot portion of the hot-and-cold product. Examples of outer portion 12 may include cookie, brownie, cake, pie, cobbler, savory dough, pastry dough, bread, doughnut, batter dough, crumb crust, solid or semi-solid fruit composition, etc. In an embodiment, outer portion 12 is a savory protein component such as, for example, chicken, beef, tofu, or seafood items. Outer portion 12 may also be a savory dough-based item such as, for example, a pizza dough, crust, bread, tortilla, etc., or a sandwich dough, crust, bread, etc.

For example, and as shown by FIG. 2, microwaveable food 10 may be a solid or semisolid fruit composition having an ice cream or custard filling. In another embodiment, outer portion 12 is a cookie or cookie dough. In another embodiment, outer portion 12 is a cake or cake dough. In yet another embodiment, outer portion 12 is a fruit composition that contains whole or crushed fruit pieces. Outer portion 12 may be sweet or savory flavored, or have any other desirable characteristics. For example, outer portion 12 may have inclusions incorporated therein to compliment the product profile. The inclusions may be, for example, fruit pieces, chocolate chips, confectionary materials, nuts, oats, herbs, spices, vegetables, cheeses, etc. Outer portion 12 may also include flavorings selected from the group consisting of butter, nut, vanilla, fruit, herb, spice, extracts, or combinations thereof.

Outer portion 12 may also include at least one topping. For example, outer portion 12 may be topped with solids, pastes, gels, syrups, sauces or other liquids. Similarly, outer portion 12 may be topped with pastes, gels, syrups, sauces or other liquids having solids or inclusions contained therein. Nonlimiting examples of outer portion 12 toppings include chocolate syrup, chocolate chips, nuts, confectionary materials, etc.

Outer portion 12 may have a thickness that allows outer portion 12 to stay warm long enough after microwave cooking to be consumed warm by the consumer. In an embodiment, outer portion 12 has a thickness that is at least 3 mm. The thickness of outer portion 12 may be from about 3 mm to about 25 mm, or from about 5 mm to about 20 mm, or from about 10 mm to about 15 mm.

In an embodiment, microwaveable food 10 includes inner filling portion 14, as discussed above, and as shown in FIG. 2. Filling 14 may be fully cooked, partly cooked or raw prior to introduction into outer portion 12. Filling 14 may be a solid, a liquid, or a semi-solid. Examples of solid fillings include, for example, dairy products, meats, cheeses, fruits, egg, or combinations thereof. Examples of liquid fillings include, for example, a sauce, a gravy, etc. In an embodiment, the liquid filling is a chocolate sauce. If the filling comprises a liquid, however, the liquid should have a sufficient viscosity such that the liquid will remain within outer portion 12 both during and after cooking, or until the integrity of outer portion 12 is compromised to release filling 14 (e.g., biting into outer portion 12). Examples of semi-solid fillings include, for example, ice cream, sorbet, sherbet mellorine, frozen yogurt, milk ice, edible emulsion, pudding, custard, cream, whipped dairy products, etc. In an embodiment, the inner, frozen or chilled portion includes savory items such as a cream sauce, cheese sauce, vegetable purees and sauces, chilled seafood, or mixed, chilled vegetable or fruit salads or any combination thereof.

Filling 14 may be cold or warm at the time of consumption. In an embodiment wherein microwaveable food 10 is a hot-and-cold product, filling 14 provides the cold portion of the product. In an embodiment, filling 14 is an ice cream. In another embodiment, filling 14 is a custard. It will be appreciated that filling 14 is not limited to the ingredients listed above, and that filling 14 may comprise any edible food.

Figure 7:
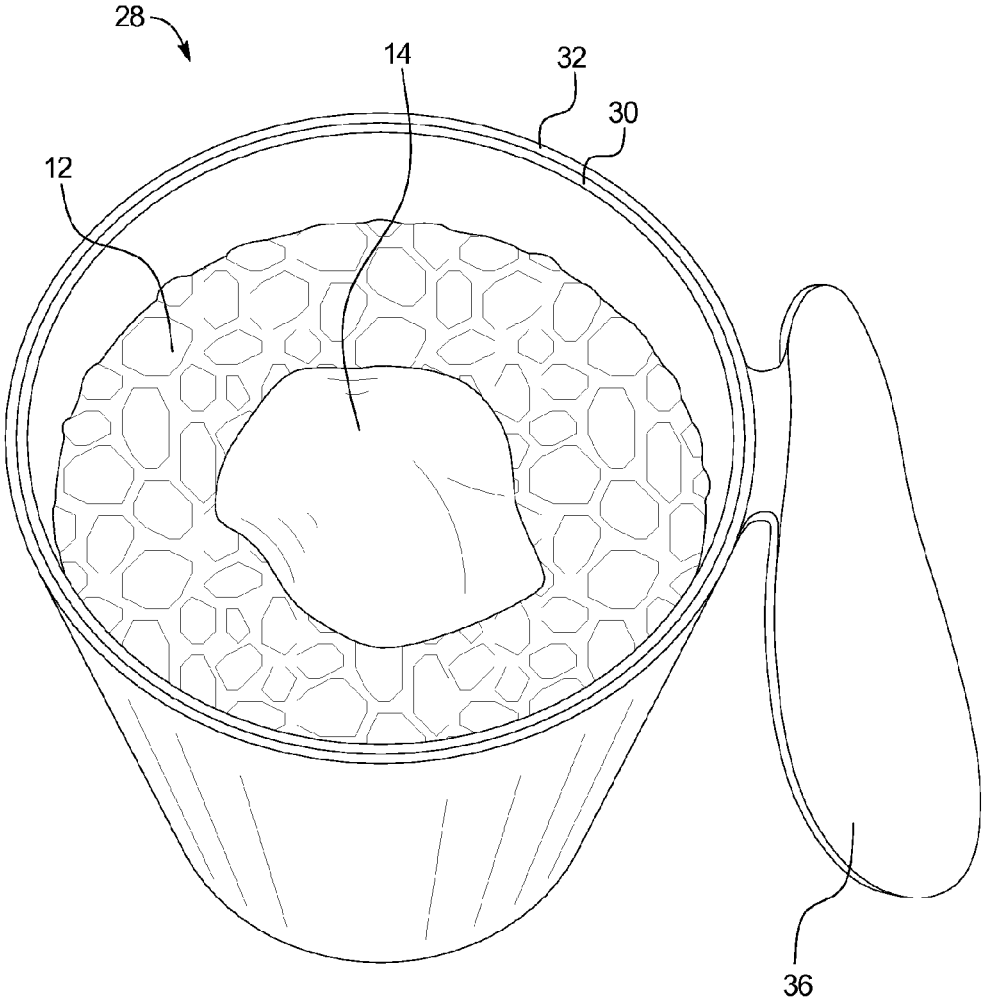
FIG. 7 is a perspective view of a microwaveable food product in accordance with an embodiment of the present disclosure.

In an embodiment, microwaveable food 10 is a frozen confectionery having a solid or semi-solid fruit outer portion 12 with an ice cream or custard filling 14, as shown by FIG. 7 and as will be discussed further below. Such a microwaveable product may provide a fun to eat, indulgent, healthy and refreshing, but offer a unique texture and taste that is distinguishable from known chilled yogurts. The solid or semi-solid fruit outer portion 12 may be, for example, a natural fruit blend comprising one part sugar and three parts of real fruit (whole, crushed, and combinations thereof). Any type of fruit may be used for the solid or semi-solid fruit outer portion including, for example, raspberries, cherries, blueberries, strawberries, mangos, peaches, oranges, etc. The inner portion of such a product may include any of the fillings listed above including, for example, custards, puddings, ice cream, sorbet, sherbet mellorine, frozen yogurt, milk ice, edible emulsion, pudding, custard, cream, etc.

In an embodiment, the filling is a superpremium ice cream. In another embodiment, the filling is an ice cream including from about 10% to about 15%, or about 12% milk fat; from about 5% to about 15%, or about 10% milk solids, non-fat; from about 15% to about 20%, or about 17% sugar; from about 0.5% to about 2%, or about 1% emulsifier and stabilizer egg yolk; and a balance amount of water (e.g., from about 50% to about 70%, or about 60%). The product may be factory assembled by freezing and coextrusion, followed by filling and final freeze hardening in single serve containers including composite susceptors of the present disclosure.

In another embodiment, microwaveable food 10 is a composite frozen confectionary having an ice cream filling 14 and a cookie or a cake encasement 12, as shown by FIG. 2. In this embodiment, microwaveable food 10 is stored frozen and is prepared in a microwave oven to heat and/or crisp the cookie portion 12, while the ice cream portion 14 remains cold. To achieve both hot and cold portions of microwaveable food 10, the packaging in which food 10 is baked should be able to both sufficiently heat the cookie portion using microwaves, while not melting the ice cream portion 14.

In another embodiment, microwaveable food 10 is a composite food product that is stored at ambient temperature and heated in a microwaveable package of the food products of the present disclosure. When an ambient temperature food product is heated in the microwaveable package, it is possible to achieve a browned or crisp surface and/or a warm or ambient temperature center. This may be advantageous when the consumer desires a creamy, not frozen or chilled, inner filling component such as, for example, a truffle filled cookie.

Baking a food product in a conventional oven provides superficial heating to the food product and requires a substantial amount of time to cook the food product entirely through. However, because the surface of a food product in a conventional oven is hottest for the longest amount of time, conventional oven cooking is able to impart to the food product a crisp, brown surface. For example, to properly bake a cookie and ice cream sandwich in a conventional oven may require baking the product at a temperature of about 550° F. (288° C.) for about five minutes. This baking process is not convenient for the consumer, however, because it is very time intensive. In this manner, preheating the oven to about 550° F. (288° C.) requires a relatively long amount of time.

To bake the cookie and ice cream product faster, microwave oven cooking can be used. However, unlike conventional oven cooking, microwaves heat a food product through the volume of the product, but typically do not achieve a browned, crisp surface since the product is almost the same temperature throughout, with slightly hotter temperatures on the outer surface of the food. To achieve a browned, crisp surface of a microwaveable food product, standard microwave susceptors, as previously described, have been used. However, standard microwave susceptors are not designed to properly cook a microwaveable food product having a frozen or chilled inner filling component inside an outer dough portion. Instead, standard microwave susceptors are likely to either i) transmit too much heat to the frozen or chilled filling such that the filling melts before completion of the baking process; or ii) crack, craze, shrink, etc. in response to large amounts of heat in the susceptor.

Figure 8:
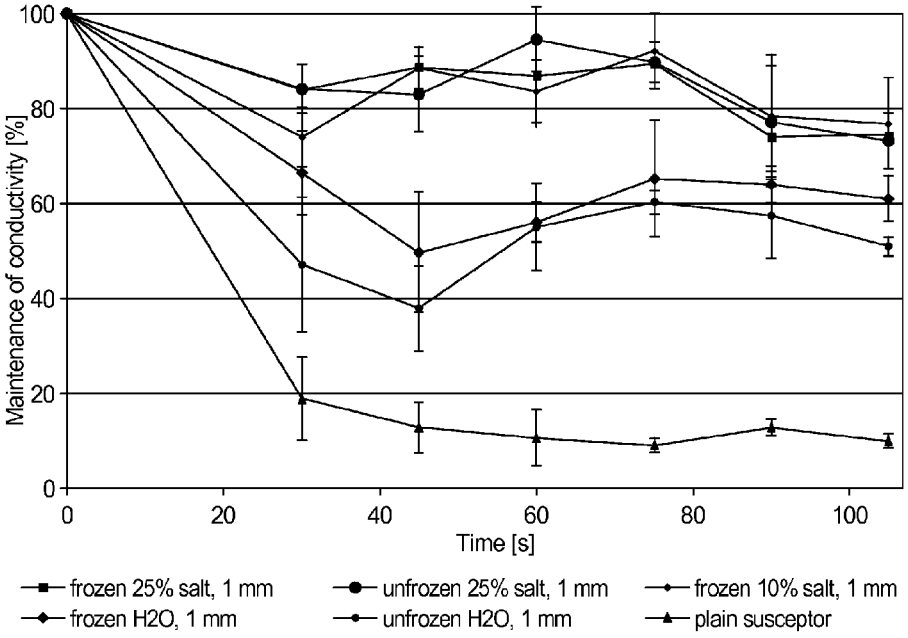
FIG. 8 is a line graph showing maintenance of electrical conductivity of several microwave susceptors in accordance with an embodiment of the present disclosure.

At best, current microwave susceptors can either shield a food product from microwaves (e.g., plain aluminum foil), or heat the food surface, but still transmit a substantial portion of the microwaves. Additionally, known susceptors cannot be used to encase the food product from all sides because the electrical field strength in the oven rises to a level where the material yields (e.g., develops cracks) within just a few seconds, as is shown by FIG. 8, which will be discussed further below. Any cracks formed in the susceptor material can change the electrical conductivity and make the susceptor more transmissive, which imparts too much heat to the food product. Consequently, susceptor materials loose their desired properties when such cracks form.

The microwaveable packaged food products and methods of the present disclosure are directed to overcoming the above-described poor heating performance of standard microwave susceptor materials. Better heating performance may be obtained by providing a highly conductive susceptor that is able to function as both a shield and a source of heat to heat a food product.

Applicants have surprisingly found that providing a highly conductive susceptor and completely encasing a food product with the highly conductive susceptor, a microwaveable package can impart a temperature profile that shifts the heating pattern from typical microwave volumetric heating toward increased surface heating. In an embodiment, a highly conductive susceptor is a composite susceptor that includes at least one standard susceptor layer and a shielding layer having a source of mobile charges, wherein the source of mobile charges is at least substantially metal free.

In a general embodiment, the composite microwaveable packages of the food products of the present disclosure may include one to three layers of a standard microwave susceptor, to which another layer, designed to protect or shield, the standard susceptor from too high electrical fields, is added. The protective or shielding layer of the present disclosure is at least substantially free of metal such that the protective or shielding layer cannot be a standard microwave susceptor layer.

Figure 3:
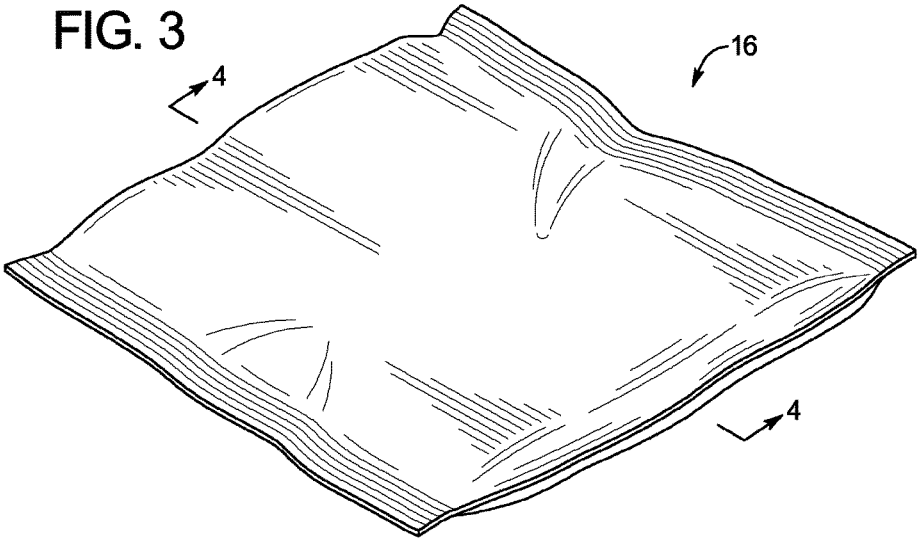
FIG. 3 is a perspective view of a microwaveable package in accordance with an embodiment of the present disclosure.
Figure 4:
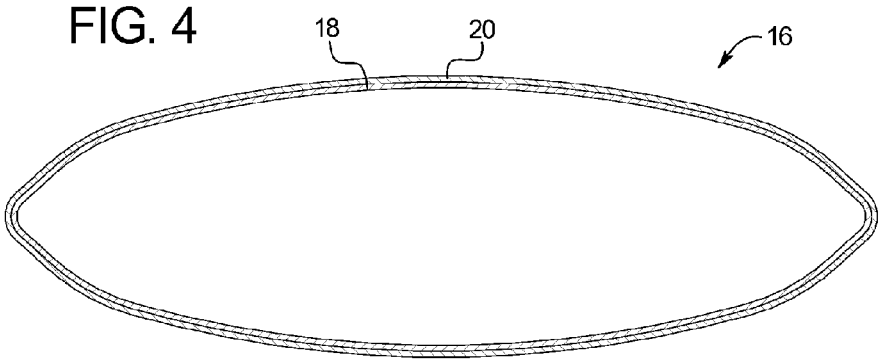
FIG. 4 is a cross-sectional view of the microwaveable package of FIG. 3 taken along line 4-4 in accordance with an embodiment of the present disclosure.

As shown in FIG. 3, a microwaveable package 16 is provided as a flexible pouch. The flexible pouch may include a composite susceptor that has one to three layers of a standard microwave susceptor material, along with at least one shielding layer. For example, FIG. 4 illustrates a cross-section of microwaveable package 16, which includes a standard susceptor layer 18 and a shielding layer 20. Standard susceptor layer 18 and shielding layer 20 form a composite susceptor that is able to provide for differential temperatures during microwave heating. The skilled artisan will appreciate that shielding layer 20 may be attached to standard susceptor layer 18 by any known means including, for example, an adhesive such as glue, tape, or combinations thereof. Although not shown, microwaveable package 16 may include an outermost layer that acts as a base packaging layer to protect standard susceptor layer 18 and a shielding layer 20 from the environment and during shipping and handling. Such a layer may also include, for example, product or branding information and/or indicia.

Standard microwave susceptor layer(s) 18 of the present composite susceptors may be any susceptor material known to the skilled artisan. As discussed above, standard susceptor materials typically include a substrate upon which a coating for absorption of microwave radiation is deposited, printed, extruded, sputtered, evaporated, or laminated. As mentioned previously, most standard susceptors include a paper substrate with a thin layer of aluminum deposited thereon and covered by a plastic film. The composite microwave susceptor packages of the present disclosure may include one or more layers of a standard susceptor material. In an embodiment, the composite microwave susceptor packages of the present disclosure include one layer of a standard susceptor material. In another embodiment, the composite microwave susceptor packages of the present disclosure include two or more layers of a standard susceptor material.

The protective (or shielding) layer 20 of the present composite susceptors is capable of acting as a shield to shield standard susceptor 18 from microwaves, while also acting as a conductor to increase the conductivity of standard susceptor 18. Such a shielding layer may include materials that are capable of being stored and handled at temperatures that are typical for frozen or chilled foods. The shielding layer may also include materials that can be cooked in a microwave oven or stored on a shelf.

In an embodiment, shielding layer 20 of the highly conductive susceptors of the present disclosure may have an electrical resistance between, for example, about 1Ω and about 300Ω. In an embodiment, shielding layer 20 of the highly conductive susceptors have an electrical resistance that is less than about 100Ω. In another embodiment, shielding layer 20 of the highly conductive susceptors may have an electrical resistance that is from about 10 to about 80Ω, or from about 20 to about 60Ω, or from about 30 to about 50Ω. In contrast, standard susceptors may have an electrical resistance from about 140 to about 200Ω.

The shielding layer may be continuous or discontinuous on the standard susceptor layer. For example, if the shielding layer is discontinuous, the shielding layer may be applied in strips to the standard susceptor layer, or in squares, or circles, or any other shape or pattern, so long as the shielding layer is able to shield at least a portion of the standard microwave susceptor from microwaves, as well as provide added conductivity thereto. In this manner, the shielding layer may cover from about 25% up to 100% of an outer surface of the standard susceptor layer. In another embodiment, the shielding layer may cover from about 40% up to about 80%, or about 50% to about 75% of an outer surface of the standard susceptor layer. On the other hand, the shielding layer may be continuous over the standard susceptor layer such that the shielding layer covers substantially all of an outer surface of the standard susceptor layer.

In an embodiment, the shielding layer may be a strong dielectric (a material having a high value for $\in'$) or a dielectric with a high loss factor ($\in''$). Both materials, or combinations thereof are suitable to reduce the electrical field strength at the susceptor, which prevents cracking of the susceptor. In an embodiment, the protective, or shielding layer may comprise a source of mobile charges that is at least substantially metal free. Examples of sources of mobile charges include, but are not limited to, ionic compounds (melted or dissolved), semiconductors, etc. An example of a component having very high numbers for $\in''$ includes concentrated salt solutions, melted salt, etc. However, the values of $\in''$ for concentrated salt solutions will depend on temperature. Concentrated salt solutions also offer the advantage that water can evaporate from them, which holds the susceptor at a temperature level where it heats the food but does not suffer heat damage. This concept can be referred to as "sacrificial load." It is useful in cases where the microwave power is higher than what can be dissipated in the packaging and/or food without causing damage to the susceptor. As used herein, "salt" includes any ionic compound including, for example, potassium chloride, sodium chloride, etc. In an embodiment, the salt is sodium chloride.

Shielding layer 20 may include a substrate to which a source of mobile charges is added. The substrate may be an absorbent, flexible material. For example, the substrate may be paper, paperboard, cardboard, cardstock, tissue paper, crepe paper, etc. In an embodiment, shielding layer 20 includes a paper-based substrate that has a weight up to about 100 $g/m^2$. The substrate may be selected based upon the absorbency of the substrate. In an embodiment, the substrate is a tissue paper that has a weight from about 10 to about 70 $g/m^2$, or about 15 to about 60 $g/m^2$, or about 20 to about 35 $g/m^2$.

The substrate of shielding layer 20 may have a thickness from about 0.05 mm to about 3.0 mm. In an embodiment, the substrate has a thickness from about 0.1 mm to about 2.0 mm, or from abut 0.2 mm to about 1.5 mm, or from about 0.3 mm to about 1.0 mm, or about 0.5 mm to about 0.8 mm. In an embodiment, the substrate has a thickness of about 0.25 mm. The substrate of shielding layer 20 should not be too thick to prevent standard susceptor 18 from achieving a sufficiently high baking temperature. On the other hand, the substrate of shielding layer 20 should not be too thin so as to provide poor shielding such that standard susceptor 18 rises in temperature too quickly and cracks before an optimal food surface temperature is achieved. The skilled artisan will also appreciate that the thickness of the substrate will vary depending on the specific conductivity of shielding layer 20, which will vary depending on at least temperature and the source of mobile charges.

The composition having mobile charges may be added to the substrate by any known means. For example, the composition having mobile charges may be added to the substrate by immersion, deposition, printing, extrusion, sputtering, evaporation, plating, or lamination. In an embodiment, the substrate may be dipped in an ionic solution. In an alternative embodiment, however, a substrate need not be used and shielding layer 20 may simply be a composition having mobile charges.

As briefly mentioned above, the source of mobile charges may include, for example, a salt solution, melted salt, or combinations thereof. The source of mobile charges may also include, for example, melted ionic compounds, dissolved ionic compounds, semiconductors, or combinations thereof. In an embodiment, the source of mobile charges is a sodium chloride solution in which tissue paper (as a substrate) may be dipped. The salt water (e.g., sodium chloride) solution may have a concentration from about 10% to about 30%. In an embodiment, the salt water solution has a concentration from about 12% to about 28%, or about 15% to about 25%, or about 17% to about 23%. In an embodiment, the salt water solution has a concentration of about 25%.

In another embodiment, the salt water solution may be provided in any amount up to its saturation point, which will depend on temperature. In this manner, the skilled artisan will appreciate that other salts with different solubility limits and different numbers of ions with different charges may be used. It is understood, therefore, that different salts (e.g., sodium, potassium, lithium, etc.) may provide different specific conductivities, which may require varying thicknesses of the substrates of shielding layer 20, and varying concentrations of the salt water solution. In an embodiment, the source of mobile charges is a salt water solution that has a concentration up to about 50%. For the remainder of the disclosure, shielding layer 20 of the present composite microwave susceptors will be discussed as a tissue paper substrate that is dipped in a sodium chloride salt water solution and placed on top of, or an outer portion of, standard susceptor 18. However, the skilled artisan will appreciate that other sources of mobile charges may be used with the composite susceptors of the present disclosure.

Shielding layer 20 of the present composite susceptors can serve at least two functions. First, if the food is completely covered with the present composite susceptor material, direct volumetric heating of the food product is kept very low, and the shielding layer 20 shields standard susceptor layer 18 to prevent standard susceptor layer 18 from becoming too hot and cracking. In this manner, shielding layer 20 on the outside of standard susceptor 18 provides a shielding effect for standard susceptor layer 18. Additionally, standard susceptor 18 in combination with shielding layer 20 can prevent transmission of microwaves into the food.

Shielding layer 20 also aids in increasing the heat dissipated by standard susceptor 18. For example, as will be discussed below, in a first portion of microwave cooking, the heating by standard susceptor 18 is reduced by the shielding effects of shielding layer 20. As the cooking process continues, and the water absorbed by the substrate of shielding layer 20 is evaporated, standard susceptor 18 gets the full electrical field and provides increased surface heating to a food product. Thus, both the lifetime and the heat dissipated by standard susceptor 18 are increased, with higher temperatures occurring at the end of the cooking cycle. In other words, because of the initial shielding effect of shielding layer 20, standard susceptor 18 may be used for a longer period of time without cracking or otherwise yielding.

In an embodiment wherein shielding layer 20 includes a substrate immersed in an aqueous solution (e.g., tissue paper dipped in a salt water solution), shielding layer 20 also provides the added benefit that the water absorbed by the substrate will evaporate during baking to provide a better temperature in the last portion of cooking (e.g., the last 15 to 45 seconds of cooking). In this manner, evaporation of the water in the substrate decreases the shielding effect of shielding layer 20 that is present in a first portion of baking, which allows standard susceptor 18 to increase in temperature during a second, or a last portion, of baking to provide improved heating and/or a browned, crisp surface to the food product.

For example, shielding layer 20 may provide sufficient shielding for up to 30 seconds, or up to 40 seconds or up to 45 seconds before the water in shielding layer 20 begins to evaporate and, therefore, cause shielding layer 20 to lose shielding power. In a second portion of heating (e.g., after about 20 seconds, or about 30 seconds, or about 40 seconds of a first heating time), standard susceptor 18 will ramp up in temperature quickly, which imparts a more intense surface heat to the food product being baked. This second portion of heating may also last up to 30 seconds, or up to 40 seconds or up to 45 seconds. In another embodiment, a first portion of heating may be an amount of time that is up to about 2 minutes and a second portion of heating may be an amount of time that is up to about 2 minutes. Further, the water contained in shielding layer 20 also helps to protect standard susceptor 18 by acting as a heat sink, reducing the temperature of standard susceptor 18.

Additionally, as mentioned above, adding shielding layer 20 to standard susceptor 18 creates a composite susceptor having an electrical conductivity that is greater than just standard susceptor 18 alone. For example, in an embodiment where the highly conductive susceptors are used with microwaveable packages including containers defining an interior, and the highly conductive susceptor surrounds the interior, most of the non-absorbed microwave energy is reflected back upon itself. However, due to multiple reflections in an oven, most of the reflected microwave energy will be directed to hit the composite susceptor again, which causes a higher field strength and, thus, a stronger surface heating.

Indeed, Applicants have surprisingly found that when a food product is completely enrobed in microwave shielding materials such as, for example, the highly conductive susceptors of the present disclosure, there may be essentially zero transmission of microwaves into the food. Instead, the heating configuration shifts the heating pattern in the microwave toward surface heating instead of volumetric heating. As such, the susceptors and methods of the present disclosure are able to provide food products with improved crust formation and enhanced crispness, especially when the food is entirely enrobed by the microwave shielding materials.

In an embodiment wherein the composite susceptors of the present disclosure are used in microwaveable packaging, shielding layer 20 of the present disclosure should be provided on an outside of the standard susceptor 18 so as not to contact any food contained within the packages. This may be especially important where the shielding layer is tissue paper dipped in a salt water solution because the food contained in the packaging would have undesirable properties if exposed to sodium chloride, another salt, or excessive moisture during storage.

On the other hand, however, the skilled artisan will appreciate that the inner, standard susceptor layer may have some thermal contact with a food product housed by the microwaveable package. Thermal contact between the standard susceptor layer and the food product will allow heat transfer from the standard susceptor layer to the food product, which not only heats the food product, but also helps to reduce the temperature of the standard susceptor layer to avoid cracking. In an embodiment, the composite susceptor (via the standard susceptor layer) contacts at least about 50% to about 100% of a total surface area of the microwaveable food. The composite susceptor may also contact from about 60% to about 90% of a total surface area of the microwaveable food. In an embodiment, the composite susceptor contacts about 75% of the microwaveable food. Alternatively, the composite susceptor does not contact the microwaveable food.

Further, although steam will likely be generated in a microwave packaging during microwave cooking of a food product, the steam is not intended to be used to cook the food product.

Figure 5:
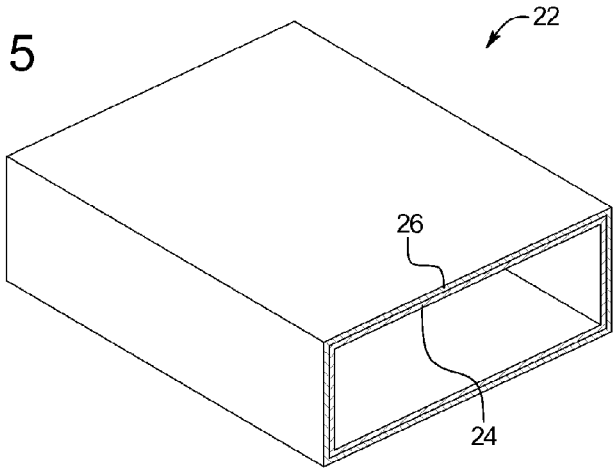
FIG. 5 is a perspective view of a cross-section of a microwaveable package in accordance with an embodiment of the present disclosure.

Returning now to FIG. 3, the skilled artisan will appreciate that microwaveable package 16 need not be provided as a pouch and may be any suitable microwaveable packaging including, for example, a box, a sleeve, a cylinder, etc., or any flexible material that may be used for packaging. Microwaveable package 16 may also be manufactured from any known packaging material including, for example, cardboard, paperboard, fibreboard, plastics, styrofoam, glass, metals, etc. Similarly, the shape of microwaveable package 16 is not limited and may be, for example, circular, oval, oblong, cylindrical, square, rectangular, etc. For example, in another embodiment, FIG. 5 illustrates microwaveable package 22 as a box having a composite susceptor of the present disclosure that includes at least one standard susceptor layer 24 and at least one shielding layer 26.

In another embodiment, a microwaveable package may include a composite susceptor of the present disclosure along all sides or walls of the package such that every surface of the microwaveable package includes a composite susceptor. In other words, the skilled artisan will appreciate that a microwaveable package may include a closed container that defines an interior, and the interior may be completely surrounded by a composite susceptor of the present disclosure. Alternatively, however, the skilled artisan will appreciate that other embodiments of microwaveable packages may include composite susceptors over only a portion of the surfaces of the microwaveable package.

Figure 6:
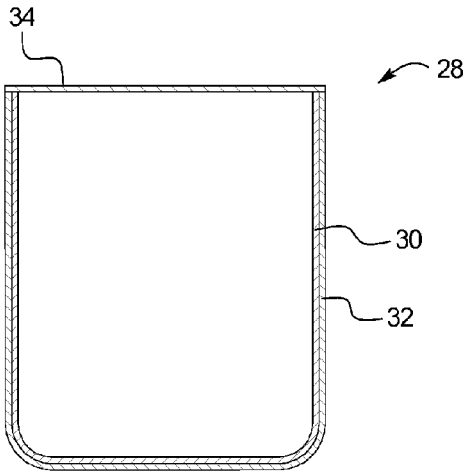
FIG. 6 is a side view of a cross-section of a microwaveable package in accordance with an embodiment of the present disclosure.

For example, as shown in FIG. 6, microwaveable package 28 includes a composite susceptor of the present disclosure including a standard susceptor layer 30 and a shielding layer 32. As illustrated, the composite susceptor is provided on a bottom of microwaveable package 28 and along cylindrical walls of microwaveable package 28. Accordingly, the composite susceptor is provided on about 75% of a total surface area of microwaveable package 28. In an embodiment, the composite susceptors of the present disclosure may be included on about 50% to 100% of a total surface area of microwaveable package 28. In another embodiment, the composite susceptors of the present disclosure may be included on about 60% to about 80% of a total surface area of microwave package 28.

Any portion of a microwaveable package that does not include a composite susceptor of the present disclosure may include any standard microwave susceptor, or any pure microwave shield component such as, for example, a metal lid, wall, bottom, etc. As used herein, a "pure microwave shield" or "complete microwave shield" means any microwave shielding material that prevents transmission of microwaves therethrough and substantially does not heat up during microwave cooking. In this manner, a pure microwave shield is distinguishable from shielding layers (e.g., shielding layer 20, shielding layer 32) of the present composite susceptors, which heat up during microwave cooking. An example of a pure, or complete, microwave shield is a metal foil such as an aluminium foil layer. For example, microwaveable package 28 of FIG. 6 includes a metal lid 34 that acts as a pure shield to prevent any microwaves from entering microwaveable package 28. Metal lid 34 may be any metal that is stable when exposed to microwaves and may be, in an example, aluminium foil.

In another embodiment, and as shown by FIG. 7, microwaveable package 28 of FIG. 6 may be used for baking cylindrically-shaped fruit and frozen confectionery products. As shown by FIG. 7, microwaveable package 28 includes a standard susceptor layer 30 and a shielding layer 32 and a lid 36, which may have a standard susceptor layer 30 and a shielding layer 32, or which may be a metal lid 34, as in FIG. 6. Microwaveable package 28 may provide improved heating of outer fruit portion 12, while preventing melting or other degradation of inner frozen ice cream or custard filling 14. In this embodiment, a consumer can microwave a single serve fruit and ice cream product immediately prior to consumption to enjoy a multi-flavored and multi-textured product comprising a steamy hot and refreshing fruit sauce, layered over a smooth and rich frozen dessert center. In an embodiment, the fruit and frozen confectionery product may be required to be heated in a microwave for an amount of time that is up to 4 minutes.

The susceptors and methods of the present disclosure are able to impart a temperature profile to a food product that is more similar to the heating pattern of a conventional oven, with the benefits of microwave cooking. In this manner, microwave heating is capable of heating a food product through its volume in a relatively short amount of time. However, typical microwave heating does not provide browning and crisping of the surface of the food product. In contrast, a conventional oven superficially heats a food product and the heat from the surface of the product is transferred toward the center of the product. In this manner, conventional oven cooking is capable of browning the surface of a food product, but requires a much longer cooking time as compared to microwave cooking. By combining the effects of microwave cooking and conventional oven cooking, the susceptors and materials of the present disclosure are able to provide the advantages of each of the cooking methods.

The susceptors and methods of the present disclosure also provide several additional consumer benefits including, but not limited to, greater surface heating of food products, insulation of a food product from the effects of heat sinks in a microwave oven environment, and retention of proper amounts of heat and moisture. Additionally, the salt contained in the shield layer helps to keep some or all of the water unfrozen at −18° C., which means that the shield is already active when the food is removed from the freezer.

Further, after evaporation of a portion of the water during microwave cooking, a consumer is able to touch the dry substrate of the shield layer without burning his or her hand.

By way of example and not limitation, the following Examples are illustrative of embodiments of the present disclosure. In the Examples, all percentages are by weight unless otherwise indicated.

EXAMPLES

Example 1—Maintenance of Conductivity

For comparison purposes, Applicants tested the maintenance of electrical conductivity of several protected (i.e., shielded) susceptors and one unprotected susceptor. The graph of FIG. 8 illustrates the protective effect of salt water layers, which were created with tissue paper as a substrate. As discussed above, however, the skilled artisan will appreciate that the shielding layer need not be comprised of tissue paper and may be any material capable of acting as a strong dielectric (a material having a high value for $\in'$) or a dielectric with a high loss factor ($\in''$). Other possibilities include, for example, paper products of other weights, fibers, yarns, cottons, etc.

FIG. 8 shows the development of conductivity of a standard (i.e., plain) susceptor, when exposed to microwaves. Without protection, the conductivity drops to below 20% after only 30 seconds. This means that the susceptor has cracked and therefore become too transmissive for the purpose of microwave cooking foods contained within the susceptor package (with strong surface heating of the susceptor). The remaining curves on the graph illustrate the maintenance of conductivity for frozen or unfrozen substrate layers of the shielding layer, with composite susceptors having tissue paper immersed in the indicated salt water concentrations. As illustrated by the graph, a 1.0 mm layer of 25% salt solution was able to keep the susceptor conductivity intact, and the shielding layer provided shielding effects when both frozen and unfrozen. However, the resulting dough temperature was not high enough. Although not graphed, Applicants achieved very good results with a 0.25 mm layer of 25% salt solution.

Example 2—Fiber-Optical Temperature Distribution Measurements

To analyze the conductivity and shielding effects of composite susceptors of the present disclosure, Applicants wrapped a dual-component microwaveable food product in a composite susceptor of the present disclosure and baked the dual-component microwaveable food in a microwave oven. The microwaveable food product was an ice cream filled cookie (17% water content, 7 mm thick around the ice cream center). In a first experiment, the ice cream filled cookie was wrapped in a standard susceptor, and in a second experiment, the ice cream filled cookie was wrapped in a composite susceptor of the present disclosure. Before wrapping, Applicants prepared the ice cream filled cookies, and placed fiber-optical probes at locations corresponding to (i) the cookie position, (ii) the ice cream position and (iii) the interface between the cookie and the ice cream.

Figure 9:
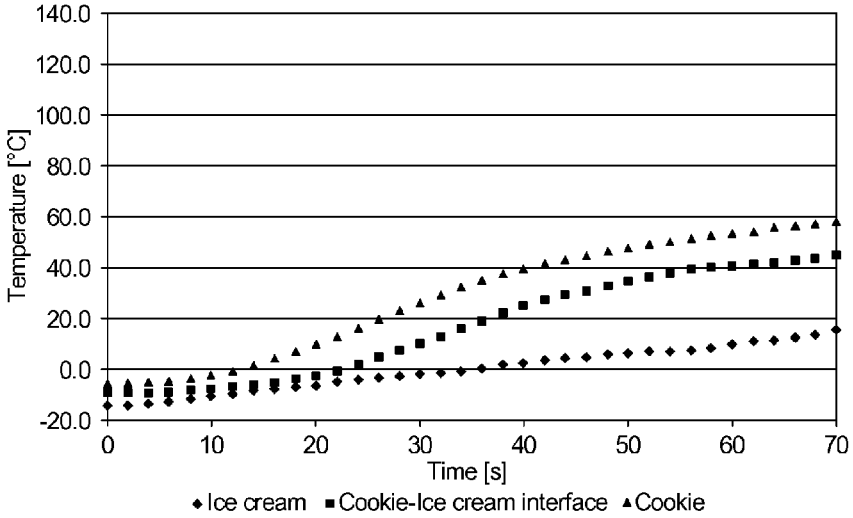
FIG. 9 is a graph of temperature v. time for an ice cream filled cookie in accordance with an embodiment of the present disclosure.

As is shown by FIG. 9, which used a standard microwave susceptor, the temperature of the ice cream quickly rises above 0° C. At the time the temperature of the ice cream is above 0° C., however, the temperature of the cookie is barely warm. As such, it is clear that standard susceptors are unable to provide a suitable temperature distribution for a hot-and-cold microwaveable product.

Figure 10:
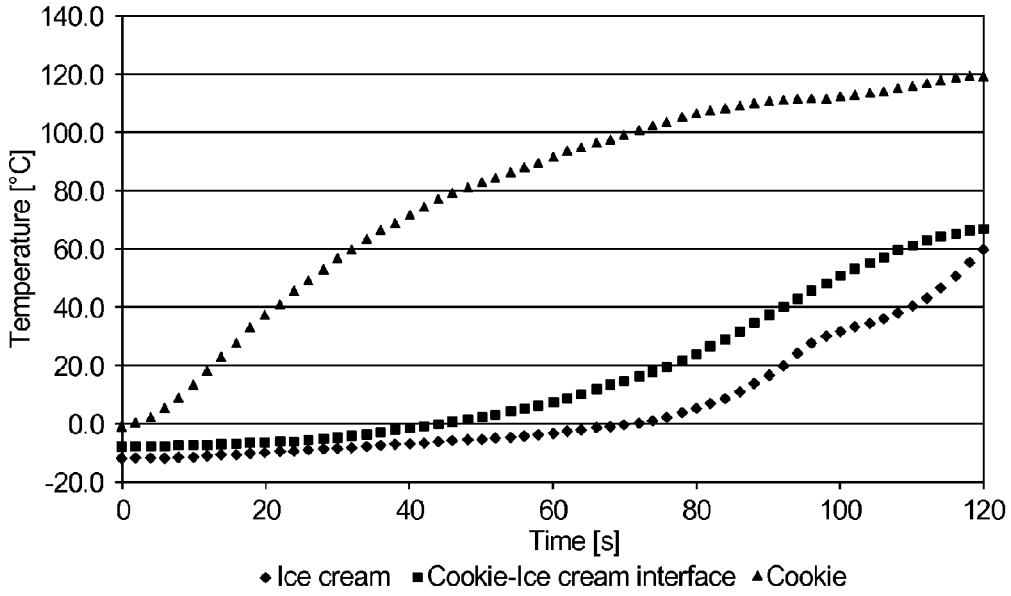
FIG. 10 is a graph of temperature v. time for an ice cream filled cookie in accordance with an embodiment of the present disclosure.

On the other hand, however, FIG. 10 is a graph of an ice cream filled cookie having the same size and composition as that in FIG. 9, but being baked in a composite susceptor of the present disclosure. The composite susceptor used in connection with FIG. 10 included two standard microwave susceptors that were covered with a shielding layer of 0.25 mm tissue paper dipped in a salt water solution of 25%. As can be clearly seen by FIG. 10, the ice cream filling stayed cold for an amount of time that was sufficient to heat the cookie to an acceptable temperature to properly bake the cookie.

Figure 11:
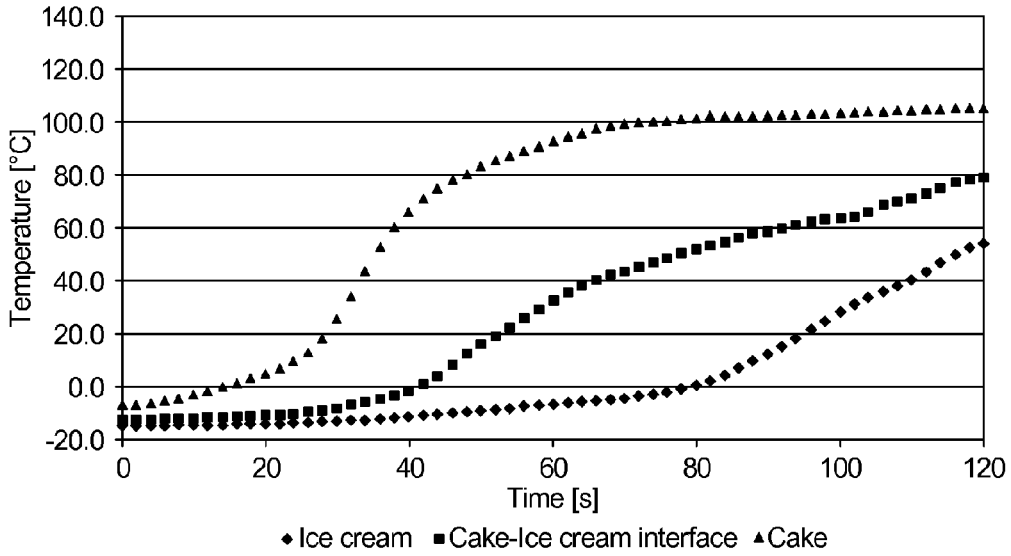
FIG. 11 is a graph of temperature v. time for an ice cream filled cake in accordance with an embodiment of the present disclosure.

For comparative reasons, FIG. 11 includes a similar curve corresponding to a cake outer portion having an ice cream filling. In this regard, the cookie casing was replaced by a cake casing that was 14 mm thick with a 32% water content. The difference in size from the cookie to the cake is because the cake composition is more porous and less compact. As can be seen in FIG. 11, there is a dramatic temperature increase in the cake composition, which Applicants believe may be due to complex heat transfer mechanisms. Indeed, without being bound to any theories, Applicants believe that the heat transfer mechanism of the dough portion of the present microwaveable food can include both classical conduction and evaporation/condensation. In this regard, a more porous dough with a higher water content tends to show a steeper temperature curve, which is desirable with a hot-and-cold microwaveable product concept.

Figure 12:
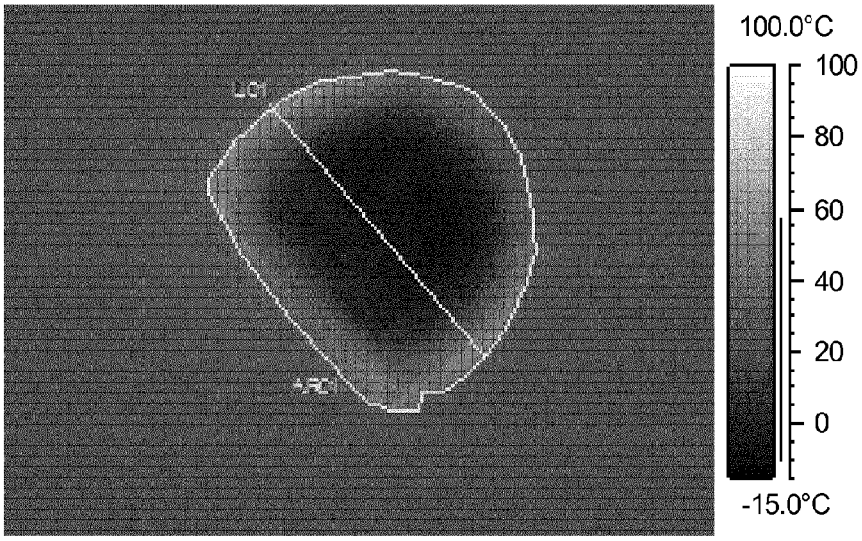
FIG. 12 is temperature profile for a microwaveable cookie product in accordance with an embodiment of the present disclosure.
Figure 13:
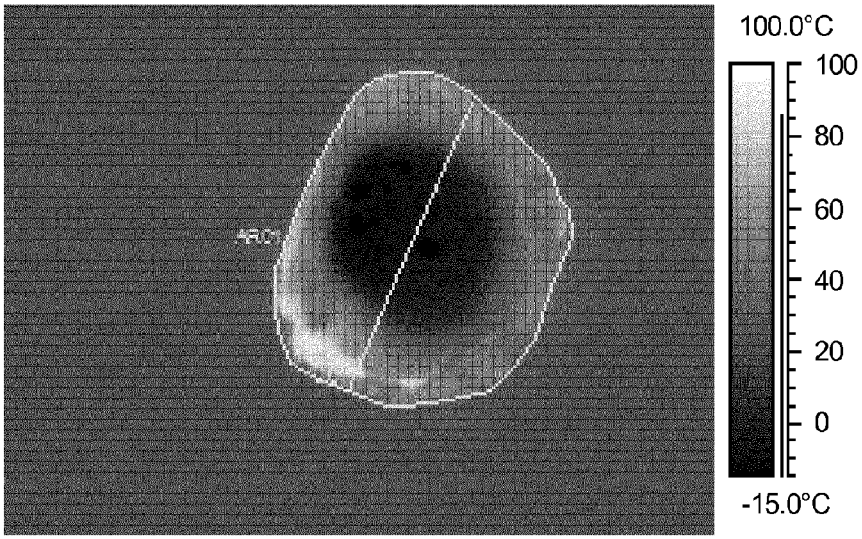
FIG. 13 is temperature profile for a microwaveable cake product in accordance with an embodiment of the present disclosure.

To further evaluate heat transfer mechanisms of different dough compositions, Applicants wrapped one pure cookie product (e.g., no ice cream) in aluminum foil and one pure cake product (e.g., no ice cream) in aluminum foil and deep-fried the products at 180° C. for two minutes. FIG. 12 shows an infrared picture of the cookie product and FIG. 13 shows an infrared picture of the cake product. Based on these two images, it appears that the cake product heats up to a greater temperature on the outside (it has a lower heat capacity by volume), but leaves the center colder. This phenomenon is understood when taking into account that the heat transfer coefficient in the case of evaporation/condensation is very temperature dependent. Where the material is hot, more water has been evaporated, which will carry more latent heat towards the colder areas. In the colder areas near the center, evaporation is insignificant. Applicants believe that the porous nature of the cake product in FIG. 13 shows less conduction than the cookie of FIG. 12, which leaves the center of the cake colder.

Example 3—Comparison of Conventional Oven Baking and Microwave Oven Baking

To determine whether the composite susceptors of the present disclosure impart an acceptable temperature profile to a hot-and-cold food cooked in a microwave oven that is similar to the temperature profile imparted by a conventional oven, Applicants performed the following experiment.

An ice cream filled cookie was prepared using a cookie dough formulation according to the recipe in Table 1 below.

TABLE 1

List of Ingredients for Cookie Dough

| Ingredients | Amount (%) |
|---|---|
| Margarine/Butter blend | 14.3 |
| Sugar | 25.6 |
| Salt | 0.3 |
| Vanilla Flavor | 0.5 |
| Wheat Flour | 45.8 |
| Sodium Bicarbonate | 0.3 |
| Rice Starch | 1.1 |
| Cellulose Gum | 0.2 |
| Whole Egg Powder | 2.1 |
| Water | 9.8 |

The ice cream filling was a vanilla ice cream.

Conventional Oven Cooking

The ice cream filled cookie was baked in a conventional oven until the desired level of cooking was achieved in order to determine the temperature profile of an ice cream filled cookie baked in a conventional oven. The ice cream filled cookie was baked in a pre-heated conventional oven for about 5 minutes at a temperature of about 287° C. The temperature distribution of the baked ice cream filled cookie was determined using thermal imaging. The thermal distribution is set forth in FIG. 14.

Microwave Oven Cooking

A second ice cream filled cookie was placed in a composite microwave susceptor of the present disclosure and cooked in a microwave oven until desired cooking was achieved. The composite susceptor included two layers of a standard susceptor material plus a layer of 0.25 mm tissue paper soaked in a 25% salt water solution. The ice cream filled cookie was cooked in the composite susceptor for about 60 seconds in an 800 Watt microwave oven. The temperature distribution of the ice cream filled cookie was determined using thermal imaging. The thermal distribution is set forth in FIG. 15.

Figure 14:
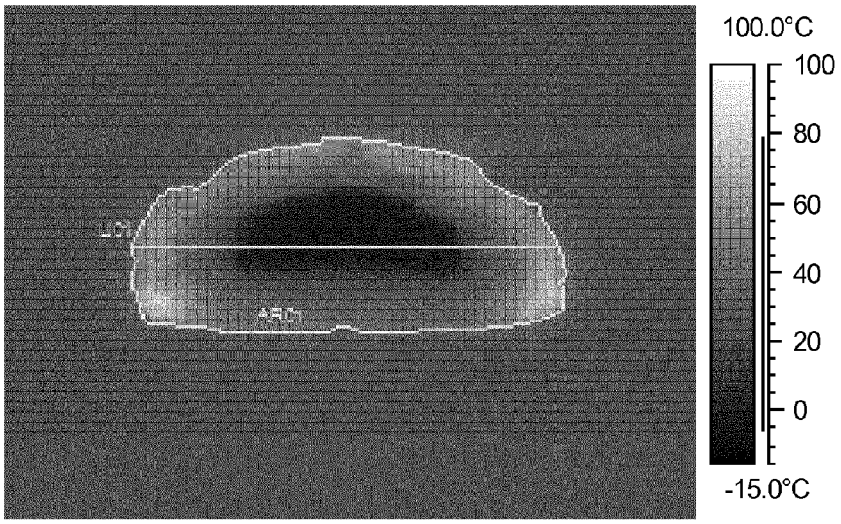
FIG. 14 is a temperature profile of a microwaveable food product baked in a conventional oven in accordance with an embodiment of the present disclosure.
Figure 15:
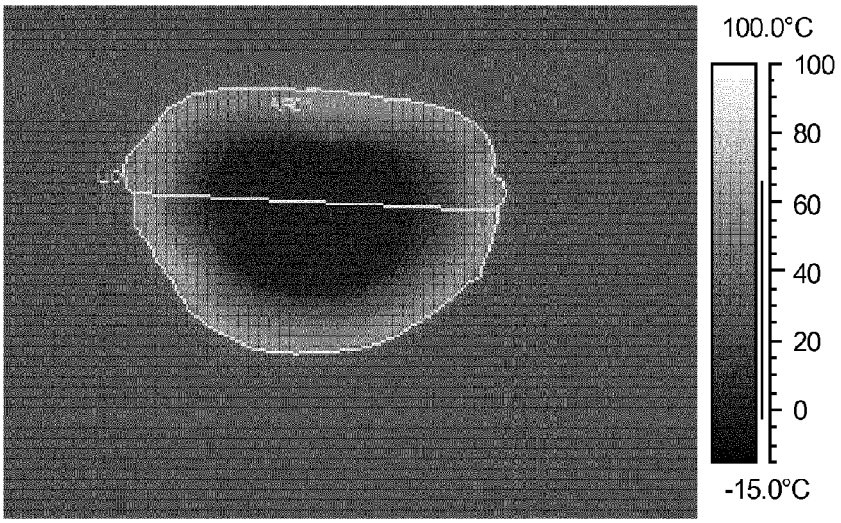
FIG. 15 is a temperature profile of a microwaveable food product baked in a microwave oven in accordance with an embodiment of the present disclosure.

As can be seen by the comparison of FIGS. 14 and 15, the second ice cream filled cookie that was cooked in a composite susceptor of the present disclosure in a microwave oven has a temperature distribution that is similar to the first ice cream filled cookie that was baked in a conventional oven. Indeed, Applicants have found that the double layer of a standard susceptor plus a 0.25 mm layer of 25% salt solution provided results that were almost identical to the ice cream cookie baked in the conventional oven. This is advantageous because the present composite susceptors now allow a hot-and-cold food product to be prepared in a reasonable amount of time, with more efficient energy consumption than with a conventional oven, and with increased surface heating while maintaining the frozen or chilled nature of the cold inner portion.

It should be understood that various changes and modifications to the presently preferred embodiments described herein will be apparent to those skilled in the art. Such changes and modifications can be made without departing from the spirit and scope of the present subject matter and without diminishing its intended advantages. It is therefore intended that such changes and modifications be covered by the appended claims.

The invention is claimed as follows:

1. A microwaveable package comprising:

a composite susceptor including a standard microwave susceptor layer having an outer surface that is attached to a microwave shielding layer comprising a substrate including a salt water solution having a concentration from about 15% to about 30% by weight as a source of mobile charges, the substrate is selected from the group consisting of paper, paperboard, cardboard, cardstock, tissue paper, crepe paper, and combinations thereof, the microwave shielding layer is at least substantially metal free, a first inner surface of a first portion of the standard microwave susceptor layer faces a second inner surface of a second portion of the standard microwave susceptor layer to form therebetween at least part of an interior of the microwaveable package, and the outer surface of the standard microwave susceptor layer faces an exterior of the microwaveable package and is located on a side of the standard microwave susceptor layer that is opposite the interior of the microwaveable package, with a first outer surface of the first portion of the standard microwave susceptor layer facing an opposite direction relative to a second outer surface of the second portion of the standard microwave susceptor layer.

2. The microwaveable package according to claim 1, wherein the substrate has a thickness from about 0.05 mm to about 3.0 mm.

3. The microwaveable package according to claim 1, further comprising a second standard microwave susceptor layer located between the first standard microwave susceptor layer and the microwave shielding layer.

4. The microwave package according to claim 1, further comprising a pure microwave shield layer that is separate from the standard microwave susceptor layer and the microwave shielding layer.

5. The microwaveable package according to claim 4, wherein the pure microwave shield layer comprises a metal foil.

6. A microwaveable package comprising:

a standard microwave susceptor layer; and a microwave shielding layer comprising a substrate including a salt water solution having a concentration from about 15% to about 30% by weight as a source of mobile charges, the microwave shielding layer is at least substantially metal free, so constructed and arranged to (i) shield the standard microwave susceptor layer from microwaves in a first portion of microwave heating and (ii) to allow the temperature of the standard microwave susceptor layer to rapidly increase during a second portion of microwave heating, and attached to an outer surface of the standard microwave susceptor layer, the substrate is selected from the group consisting of paper, paperboard, cardboard, cardstock, tissue paper, crepe paper, and combinations thereof, and a first inner surface of a first portion of the standard microwave susceptor layer faces a second inner surface of a second portion of the standard microwave susceptor layer to form therebetween at least part of an interior of the microwaveable package, and the outer surface of the standard microwave susceptor layer faces an exterior of the microwaveable package and is located on a side of the standard microwave susceptor layer that is opposite the interior of the microwaveable package, with a first outer surface of the first portion of the standard microwave susceptor layer facing an opposite direction relative to a second outer surface of the second portion of the standard microwave susceptor layer.

7. The microwaveable package according to claim 6, wherein the first portion of microwave heating comprises an amount of time that is up to about 40 seconds.

8. The microwaveable package according to claim 6, wherein the second portion of microwave heating is after the first portion of microwave heating and comprises an amount of time that is up to about 40 seconds.

9. The microwaveable package according to claim 6, wherein the microwave shielding layer comprises a substrate having a thickness from about 0.05 mm to about 3.0 mm.

10. The microwaveable package according to claim 6, further comprising a second standard microwave susceptor layer located between the first standard microwave susceptor layer and the microwave shielding layer.

11. The microwave package according to claim 6, further comprising a pure microwave shield layer that is separate from the standard microwave susceptor layer and the microwave shielding layer.

12. A method for making a microwaveable package comprising a composite microwave susceptor, the method comprising:

providing a standard microwave susceptor layer;

providing a microwave shielding layer comprising a substrate including a salt water solution having a concentration from about 15% to about 30% by weight as a source of mobile charges, wherein the microwave shielding layer is at least substantially metal free, and the substrate is selected from the group consisting of paper, paperboard, cardboard, cardstock, tissue paper, crepe paper, and combinations thereof; and attaching the microwave shielding layer to an outer surface of the standard microwave susceptor layer to form the microwaveable package, a first inner surface of a first portion of the standard microwave susceptor layer faces a second inner surface of a second portion of the standard microwave susceptor layer to form therebetween at least part of an interior of the microwaveable package, and the outer surface of the standard microwave susceptor layer faces an exterior of the microwaveable package and is located on a side of the standard microwave susceptor that is opposite the interior of the microwaveable package, with a first outer surface of the first portion of the standard microwave susceptor layer facing an opposite direction relative to a second outer surface of the second portion of the standard microwave susceptor layer.

13. The method according to claim 12, wherein the substrate includes the source of mobile charges.

14. The method according to claim 12, wherein the substrate is a paper-based substrate that has a thickness from about 0.05 mm to about 3.0 mm.

15. The microwaveable package according to claim 1, wherein the standard microwave susceptor layer is enclosed by the microwave shielding layer.

* * * * *